US007948374B2

(12) United States Patent
Chen

(10) Patent No.: US 7,948,374 B2
(45) Date of Patent: May 24, 2011

(54) TWO-WAY REMOTE CONTROL UNIT

(76) Inventor: Tse Hsing Chen, Chung-Ho (TW)

( * ) Notice: Subject to any disclaimer, the term of this patent is extended or adjusted under 35 U.S.C. 154(b) by 279 days.

(21) Appl. No.: 12/318,613

(22) Filed: Jan. 2, 2009

(65) Prior Publication Data

US 2010/0171612 A1 Jul. 8, 2010

(51) Int. Cl.
*G08B 1/08* (2006.01)

(52) U.S. Cl. ..... 340/539.32; 340/539.11; 340/571; 340/825.49

(58) Field of Classification Search ..... 340/539.32, 340/571, 825.49, 825.69, 825.72, 539.1, 340/539.11
See application file for complete search history.

(56) References Cited

U.S. PATENT DOCUMENTS

| | | | | |
|---|---|---|---|---|
| 7,453,357 | B2 * | 11/2008 | Bernal-Silva et al. | 340/539.32 |
| 2004/0017293 | A1 * | 1/2004 | Webster | 340/539.32 |
| 2006/0170546 | A1 * | 8/2006 | Clifford | 340/539.32 |
| 2007/0279220 | A1 * | 12/2007 | Wilcox | 340/539.32 |

* cited by examiner

*Primary Examiner* — Hung T. Nguyen
(74) *Attorney, Agent, or Firm* — Bacon & Thomas, PLLC

(57) ABSTRACT

A two-way remote control unit includes at least one two-way remote controller provided with remotely calling and locating functions, so that a user can save the money that is otherwise needed for purchasing an additional calling device or a finder for calling or locating the remote controller, and needs not to troublesomely carry the calling device and finder around. Users can use two-way remote controllers of the same type to call or locate one another, and the two-way remote controller can be conveniently used as a finder, too.

10 Claims, 4 Drawing Sheets

TWO-WAY REMOTE CONTROL UNIT

FIELD OF THE INVENTION

The present invention relates to a two-way remote control unit, and more particularly to a two-way remote control unit that includes two-way remote controllers provided with calling and locating functions, so as to enable users thereof to call or locate one another via the remote controllers, or be conveniently used as a finder.

BACKGROUND OF THE INVENTION

For people who love to watch television or drive a car, it is an unpleasant experience of taking time to locate a missing remote controller. A finder adapted to produce buzz is available in the market for solving the problem of locating a missing remote controller. The finder structurally includes two parts, one of which is a small piece of locating alarm for attaching to an easily missing item, such as a remote controller, a watch, a key, a Braille stylus, a purse, etc., and the other part is a main body of the finder provided with a push button. When the push button on the main body is pushed, the locating alarm attached to the item will buzz. The user can follow the buzz to locate the missing item easily.

While the finder is convenient for use, it inevitably increases the user's burden in buying and carrying the finder around.

On the other hand, there are many commercially available remote controllers having been provided with a signal transmitting and receiving function and a warning function. However, such functions have not been well planned and fully utilized. For example, in the two-way car antitheft unit very common in the market, the two-way remote controller thereof can not only transmit a signal to remotely control a car for the antitheft purpose, but also receive a trigger warning signal when the antitheft unit is triggered. Once the trigger warning signal is received, the remote controller will produce warning sound or vibration, or show an image to warn the user. The car remote controller can also be used to remotely control one car, two cars, or multiple cars at the same time. However, the currently available car antitheft remote control unit is generally used only to remotely enable and discernable the antitheft unit or receive the trigger warning signal without being further utilized as a finder or a calling device for finding an item or a person.

SUMMARY OF THE INVENTION

A primary object of the present invention is to provide a two-way remote control unit that includes two-way remote controllers with calling and locating functions. Therefore, it is not necessary for users to expend additional money to buy a calling device or a finder, or troublesomely carry the calling device or finder around.

Another object of the present invention is to provide a two-way remote control unit that includes two-way remote controllers with calling and locating functions, so that users using the same type of two-way remote controllers can conveniently call or locate one another using the two-way remote controllers without the need of purchasing a calling device or a finder.

To achieve the above and other objects, the two-way remote control unit according to the present invention includes a first two-way remote controller being provided with a first code learning button and a first calling button; and a second two-way remote controller being provided with a second code learning button and a second calling button.

When the second code learning button is pressed, and then the first calling button is pushed to transmit a first calling code, the first calling code will be learned into the second two-way remote controller, so that the first two-way remote controller can remotely call and locate the second two-way remote controller, the user thereof, or an article connected thereto.

When the first code learning button is pressed, and then the second calling button is pushed to transmit a second calling code, the second calling code will be learned into the first two-way remote controller.

Therefore, the first and the second two-way remote controller can remotely call or locate each other without being divided into a master and a slave remote controller.

And, one of the first and the second two-way remote controller that is being called or located would produce a sound and/or display a message showing the calling remote controller, so as to facilitate locating of the remote controller being called.

The first and the second two-way remote controller can be used as calling devices for two users thereof to remotely call each other, or as finders to locate an article connected to the other remote controller. The users can save money for purchasing additional calling devices or finders, and need not to troublesomely carry the calling devices or finders around.

The two-way remote control unit of the present invention can have different applications. For example, it is also possible to perform one-directional or bi-directional one-to-one or one-to-multiple calling or locating among a plurality of two-way remote controllers, or perform mutual calling or locating among a plurality of two-way remote controllers and two-way finders.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
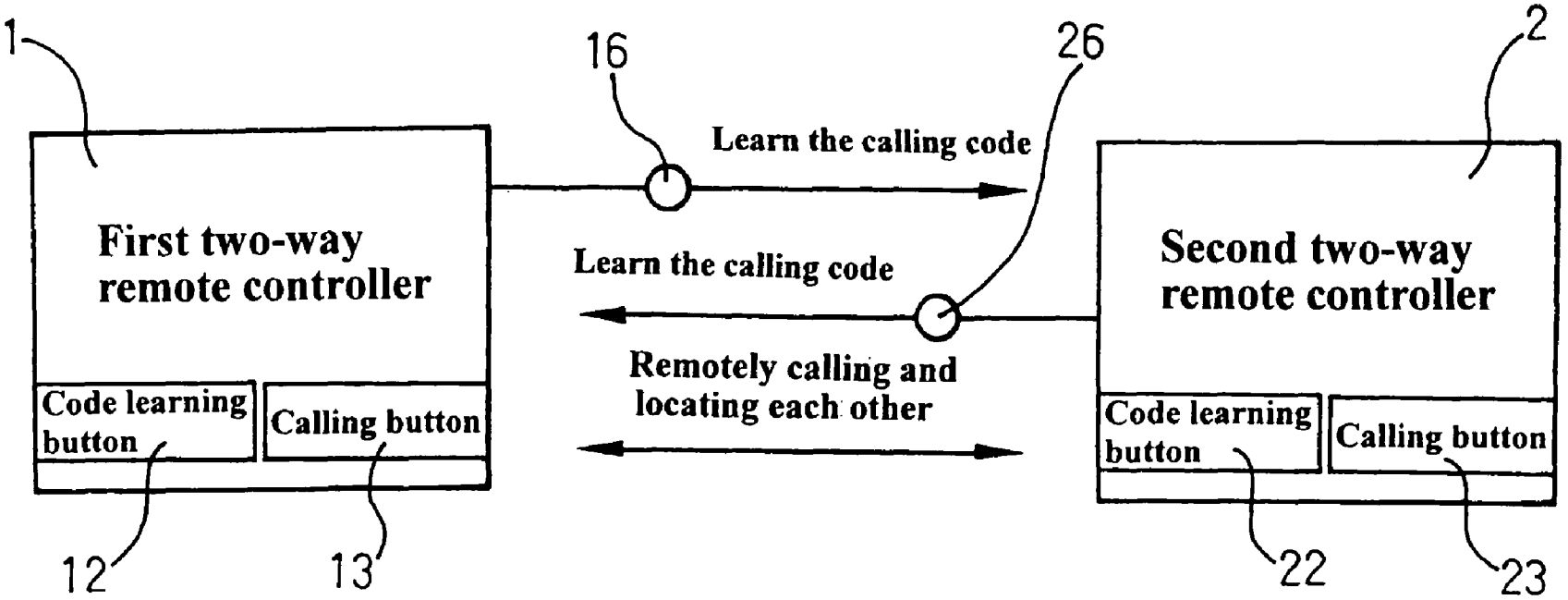
FIG. 1 is a block diagram of a two-way remote control unit according to a first embodiment of the present invention, in which two two-way remote controllers thereof are able to remotely call each other.

Please refer to FIG. 1 that is a block diagram showing a two-way remote control unit according to a first embodiment of the present invention. In FIG. 1, the two-way remote control unit includes a first two-way remote controller 1 provided with a code learning button 12 and a calling button 13, and a second two-way remote controller 2 provided with a code learning button 22 and a calling button 23.

When the second code learning button 22 is pressed, and then the first calling button 13 is pushed to transmit the first calling code 16, the first calling call 16 will be learned into the second two-way remote controller 2, so that the first two-way remote controller 1 can remotely call the second two-way remote controller 2.

Similarly, when the first code learning button 12 is pressed, and then the second calling button 23 is pushed to transmit the second calling code 26, the second calling code 26 will be learned into the first two-way remote controller 1, so that the second two-way remote controller 2 can remotely call the first two-way remote controller 1. Therefore, the first and the second two-way remote controller 1, 2 can remotely call each other.

Figure 2:
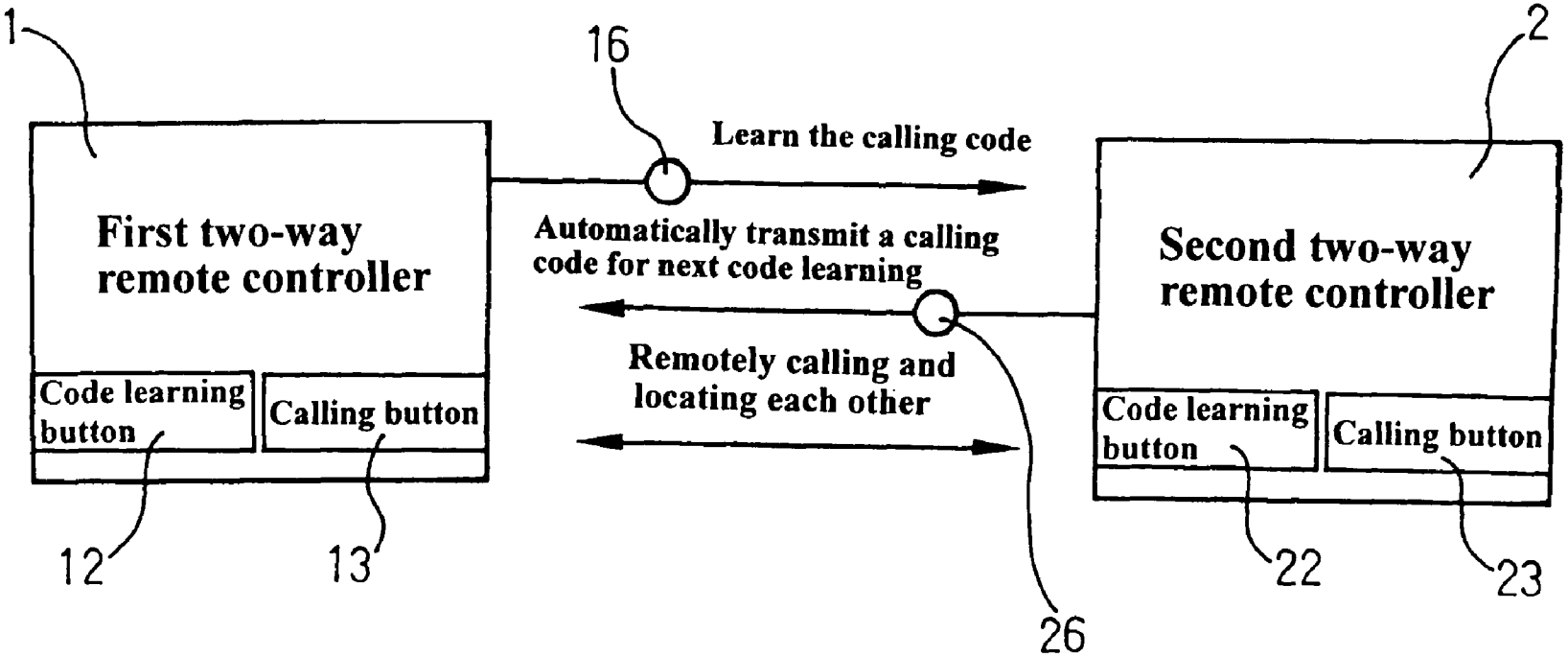
FIG. 2 is a block diagram of a two-way remote control unit according to a second embodiment of the present invention, in which two two-way remote controllers thereof are able to remotely call and locate each other.

FIG. 2 is a block diagram of a two-way remote control unit according to a second embodiment of the present invention.

In FIG. 2, the two-way remote control unit includes a first two-way remote controller 1 provided with a code learning button 12 and a calling button 13, and a second two-way remote controller 2 provided with a code learning button 22 and a calling button 23.

When the second code learning button 22 is pressed, and then the first calling button 13 is pushed to transmit the first calling code 16, the first calling code 16 will be learned into the second two-way remote controller 2. After the learning, the second two-way remote controller 2 will automatically transmit its own calling code 26, and the first two-way remote controller 1 also will automatically switch to a code learning mode to learn in the calling code 26. Therefore, both of the first and the second two-way remote controller 1, 2 can learn the calling code transmitted from the other one and can thereby remotely call each other.

Similarly, when the first code learning button 12 is pressed, and then the second calling button 13 is pushed to transmit the second calling code 26, the second calling code 26 will be learned into the first two-way remote controller 1. After the learning, the first two-way remote controller 1 will automatically transmit its own calling code 16, and the second two-way remote controller 2 also will automatically switch to a code learning mode to learn in the calling code 16. Therefore, both of the first and the second two-way remote controller 1, 2 can learn the calling code transmitted from the other one and can thereby remotely call each other.

In an operable embodiment of the present invention, when the calling code 16 from the first two-way remote controller 1 is received by the second two-way remote controller 2, the calling code 16 is decoded. And, when the decoded calling code 16 is found as correct, the second two-way remote controller 2 will produce a sound and display a message that the first two-way remote controller 1 is calling. Therefore, in practical use of the two-way remote control unit of the present invention, a user can utilize the sound produced by the second two-way remote controller 2 to locate the second two-way remote controller 2, a current holder thereof, or a key or other article that is connected thereto.

In another operable embodiment of the present invention, when receiving the calling code 16 from the first two-way remote controller 1, the second two-way remote controller 2 can, in addition to produce the sound, automatically transmit an intermittent signal at short intervals without consuming too much power. The first two-way remote controller 1 receives the intermittent signal and the user can determine a distance between the first and the second two-way remote controller 1, 2 according to an intensity of the received signal. When the distance between the first and the second two-way remote controller 1, 2 becomes closer, the received signal will become stronger, too. Meanwhile, the sound produced by the first two-way remote controller 1 will also become louder or quicker to indicate the distance between the two controllers 1, 2 is further decreased. The intermittent signal and the sound will no doubt facilitate easy locating of the second two-way remote controller 2.

Alternatively, in a further operable embodiment of the present invention, based on the principle that a signal becomes weaker when a transmission distance thereof is longer, a certain signal receiving strength is preset as a reference value and an allowable range of error for the reference value is also preset. In the event the received intermittent signal has intensity lower than the preset reference value by a certain percentage, it means a distance between the two remote controllers 1, 2 is become larger. Meanwhile, the first two-way remote controllers 1 can produce a sound to warn the user of the increased distance between the two remote controllers 1, 2.

Using the same manner, the second two-way remote controller 2 can also be used to call and locate the first two-way remote controller 1, or to produce a sound to warn the user of an increased distance between the second and the first two-way remote controller 2, 1.

With these arrangements, it is not necessary to use any additional calling device or finder. Therefore, the cost that is otherwise required to buy the calling device and/or the finder can be saved, and the number and weight of articles that are to be carried around by the user can be minimized.

In a further operable embodiment, the two-way remote control unit of the present invention enables not only the above-described one-to-one calling between two two-way remote controllers, but also multiple calling among a plurality of two-way remote controllers. For this purpose, the two-way remote controllers each have a display provided thereon to show multiple different remote calling choices, such as call 1/2/3/4 . . . , so that a user may select one-to-one remote calling between two two-way remote controllers, or one-to-two or multiple remote calling among more than two two-way remote controllers. In doing so, any one of the multiple two-way remote controllers can be used to locate and call other two-way remote controllers. That is, it is not necessary only a master remote controller can be used to locate other slave remote controllers. Therefore, it is able to avoid the problems of failing to locate a slave remote controller when the master remote controller is lost, or failing to locate a master remote controller or other slave remote controllers with a slave remote controller.

Figure 3:
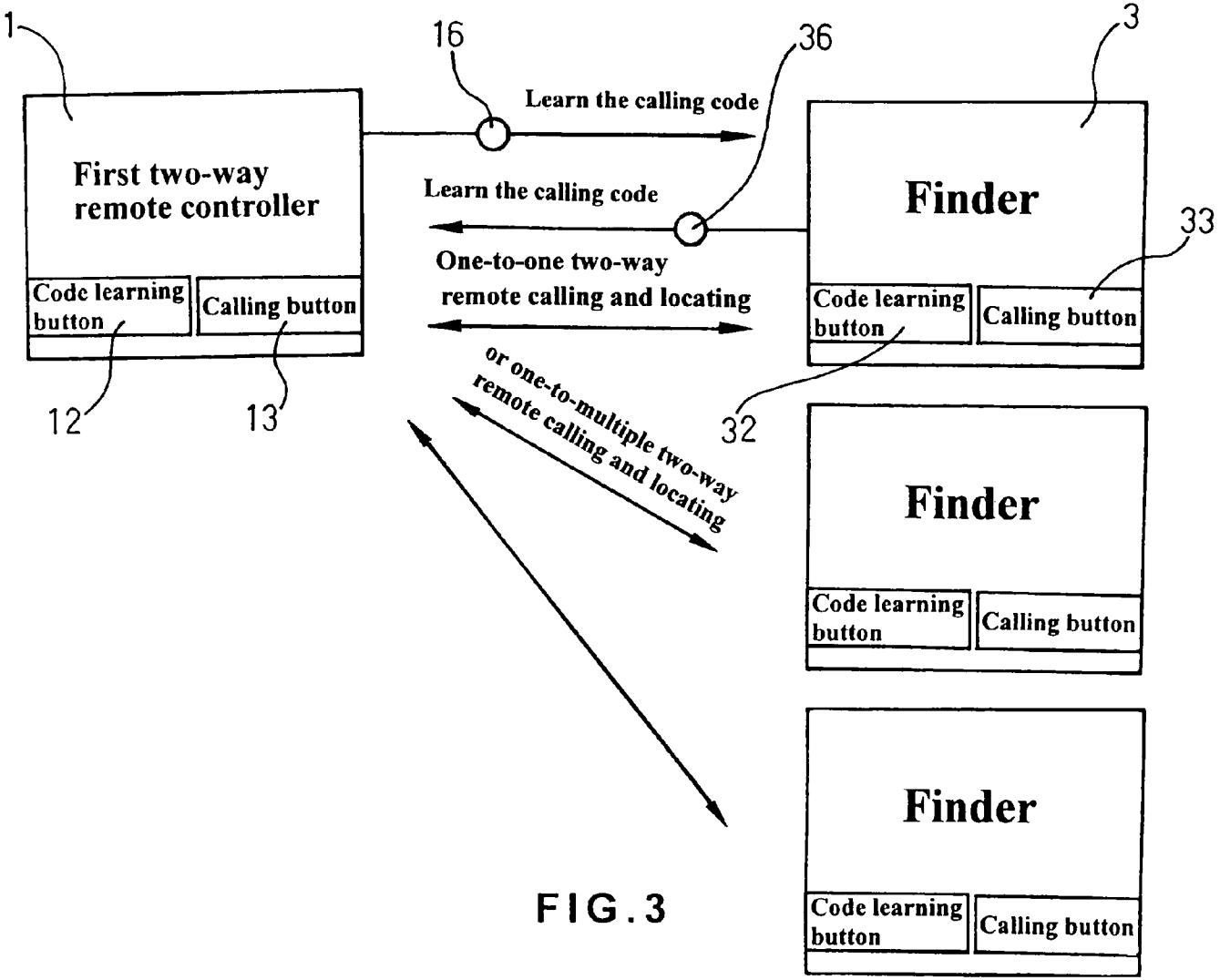
FIG. 3 is a block diagram of a two-way remote control unit according to a third embodiment of the present invention, in which a two-way remote controller and a plurality of finders thereof are able to remotely call one another.

FIG. 3 is a block diagram showing a two-way remote control unit according to a third embodiment of the present invention.

Please refer to FIG. 3. The two-way remote control unit according to the third embodiment of the present invention includes a first two-way remote controller 1 and one or more two-way finders 3. The finders 3 each are provided with a code learning button 32 and a calling button 33. The code learning button 32 has a frequency and coding and decoding procedures the same as that of the first two-way remote controller 1, so that the finders 3 and the first two-way remote controller 1 are able to remotely communicate with one another. And, each of the two-way finders 3 has a unique call code 36.

The first two-way remote controller 1 is provided with a code learning button 12 and a calling button 13. By pressing the code learning button 12, and then pushing the calling button 33 on a two-way finder 3, the first two-way remote controller 1 would be able to learn the calling code 36 of the two-way finder 3, and can therefore remotely call the two-way finder 3. Similarly, by pressing the code learning button 32 on the two-way finder 3, and then pushing the calling button 13 on the first two-way remote controller 1, the two-way finder 3 would be able to learn the calling code 16 of the first two-way remote controller 1. Therefore the two-way finder 3 can remotely locate and call the first two-way remote controller 1.

Figure 4:
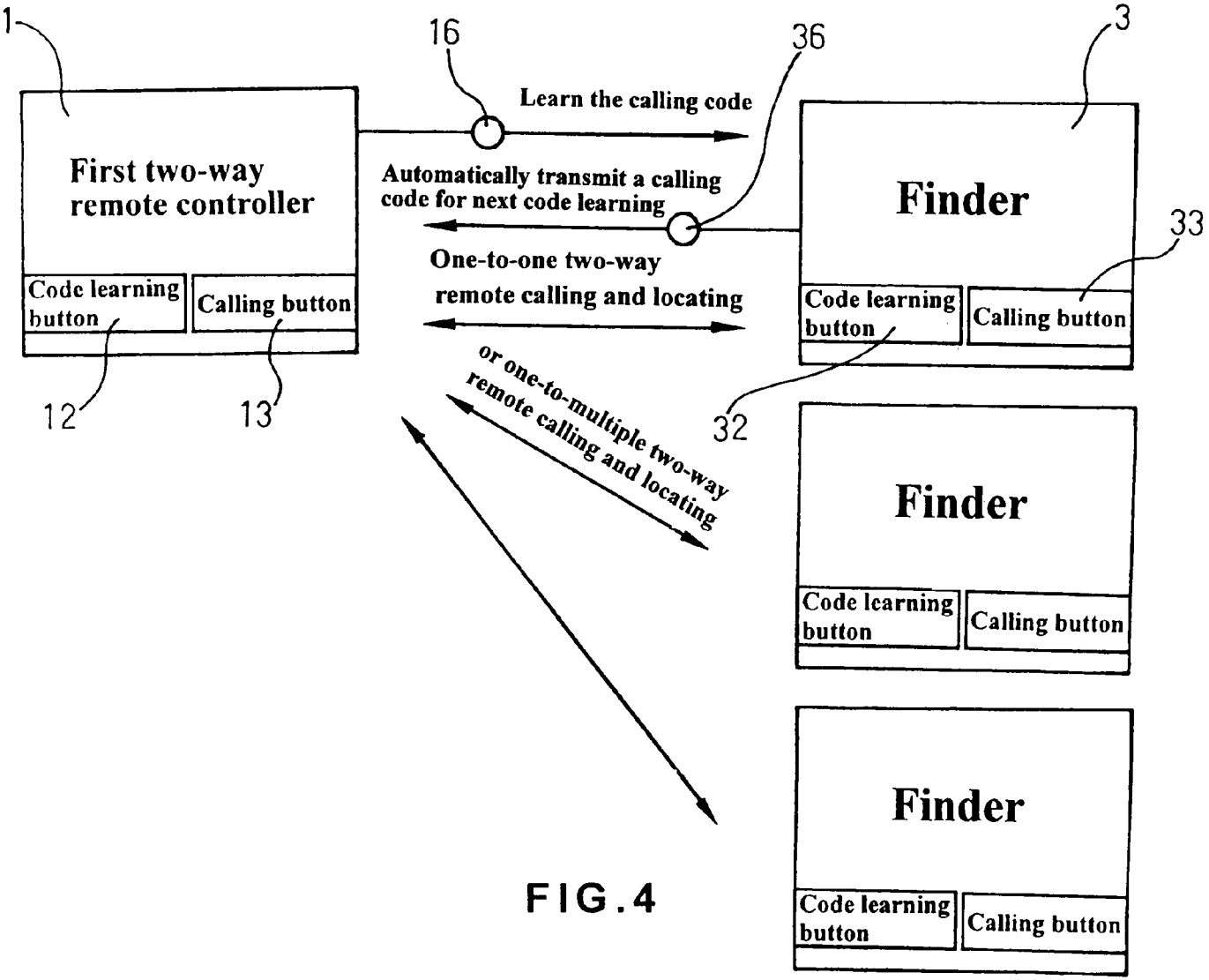
FIG. 4 is a block diagram of a two-way remote control unit according to a fourth embodiment of the present invention, in which a two-way remote controller and a plurality of finders thereof are able to remotely call and locate one another.

Alternatively, in a two-way remote control unit according to a fourth embodiment of the present invention as shown in FIG. 4, when the code learning button 12 on the first two-way remote controller 1 is pressed, and then the calling button 33 on the two-way finder 3 is pushed, the first two-way remote controller 1 is able to learn the calling code 36 of the two-way finder 3 and then automatically transmits its own calling code 16, and the two-way finders 3 also will automatically switch to a code learning mode to learn in the calling code 16, so that the first two-way remote controller 1 and the two-way finder 3 can remotely locate each other.

Similarly, when the code learning button 32 on the two-way finder 3 is pressed, and then the calling button 13 on the first two-way remote controller 1 is pushed, the two-way finder 3 would be able to learn the calling code 16 of the first two-way remote controller 1 and then automatically transmits its own calling code 36, and the first two-way remote controller 1 also will automatically switch to a code learning mode to learn in the calling code 36, so that the first two-way remote controller 1 and the two-way finder 3 can remotely locate each other. Meanwhile, according to an operable embodiment of the present invention, one of the first two-way remote controller 1 and the finder 3 that is being located would produce a sound, so that the other one, say, the remote controller 1, can follow the sound to locate the finder 3.

Moreover, according to another operable embodiment of the present invention, the first two-way remote controller 1 can cause the finder 3 to automatically generate an intermittent signal at short intervals. A user can determine a distance between the first two-way remote controller 1 and the finder 3 according to an intensity of the received intermittent signal. When the distance between the first two-way remote controller 1 and the finder 3 becomes closer, the received intermittent signal will become stronger, too. Meanwhile, the sound produced by the first two-way remote controller 1 will also become louder or quicker to indicate the distance between the first two-way remote controller 1 and the finder 3 is further decreased and therefore facilitates easier locating of the finder 3.

Alternatively, in another further operable embodiment, based on the principle that a signal becomes weaker when a transmission distance thereof is longer, a certain signal receiving strength is preset as a reference value and an allowable range of error for the reference value is also preset. In the event the received intermittent signal has intensity lower than the preset reference value by a certain percentage, it means a distance between the first remote controller 1 and the second remote controller 2 or the finder 3 is become larger. At this point, the first two-way remote controller 1 can produce a sound to warn the user of the increased distance between the first remote controller 1 and the second remote controller 2 or the finder 3.

When the calling button 13 is pushed to sequentially establish communication of the first two-way remote controller 1 with a plurality of two-way finders 3 in the above-described manner, the first two-way remote controller 1 can be switched to sequentially remotely call one or more two-way finders 3. Or reversely, the user can use one or more two-way finders 3 to call the first two-way remote controller 1. Similarly, it is also possible to use a plurality of two-way remote controllers and a plurality of two-way finders 3 to locate one another. Therefore, the application range of the two-way remote control unit of the present invention can be further expanded.

Generally, a two-way remote control unit can include one, two or more two-way remote controllers. However, for the purpose of lowering the price of the two-way remote control unit, it is also possible to include only a two-way remote controller and a one-way remote controller in the unit. The one-way remote controller is usually used as a spare, in case the two-way remote controller is lost. The one-way remote controller can also be provided with a calling button for transmitting a calling code. The two-way remote controller could also learn the calling code from the one-way remote controller. And, the one-way remote controller can also be used to remotely call one or more two-way finders.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A two-way remote control unit, comprising:

at least one first two-way remote controller being provided with a first code learning button and a first calling button; and at least one second two-way remote controller being provided with a second code learning button and a second calling button;

wherein when the second code learning button is pressed, and then the first calling button is pushed to transmit the first calling code, the first calling code will be learned into the second two-way remote controller, so that the first two-way remote controller can remotely call the second two-way remote controller, locate a holder thereof, or an article connected thereto; and when the first code learning button is pressed, and then the second calling button is pushed to transmit the second calling code, the second calling code will be learned into the first two-way remote controller, so that the second two-way remote controller can remotely call the first two-way remote controller; whereby, the first and the second two-way remote controller can remotely call each other; and wherein one of the first and the second two-way remote controller that is being called can produce a sound and/or display a message showing the calling remote controller, so as to facilitate easy locating of the remote controller being called;

whereby the first and the second two-way remote controller can be used to remotely call each other, so as to locate each other, the users thereof, or articles connected thereto; and whereby the two-way remote control unit enables not only one-to-one calling and locating between one first and one second two-way remote controller, but also multiple remote calling and locating among two or more first two-way remote controllers and two or more second two-way remote controllers.

2. A two-way remote control unit, comprising:

at least one first two-way remote controller being provided with a first code learning button and a first calling button; and at least one second two-way remote controller being provided with a second code learning button and a second calling button;

wherein when the second code learning button is pressed, and then the first calling button is pushed to transmit the first calling code, the first calling code will be learned into the second two-way remote controller; and after the learning, the second two-way remote controller will automatically transmit its own calling code, and the first two-way remote controller also will automatically switch to a code learning mode to learn in the second calling code, so that the first and the second two-way remote controller learn in each other's calling code; and when the first code learning button is pressed, and then the second calling button is pushed to transmit the second calling code, the second calling code will be learned into the first two-way remote controller; and after the learning, the first two-way remote controller will automatically transmit its own calling code, and the second two-way remote controller also will automatically switch to a code learning mode to learn in the first calling code, so that the first and the second two-way remote controller learn in each other's calling code, allowing the first and the second two-way remote controller to remotely call or locate each other; and wherein one of the first and the second two-way remote controller that is being called or located can produce a sound and/or display a message showing the calling remote controller, so as to facilitate easy locating of the remote controller being called;

whereby, the first and the second two-way remote controllers can be used to remotely call each other, so as to locate each other, the users thereof, or articles connected thereto; and whereby the two-way remote control unit enables not only one-to-one calling and locating between one first and one second two-way remote controller, but also multiple remote calling and locating among two or more first two-way remote controllers and two or more second two-way remote controllers.

3. A two-way remote control unit, comprising:

at least one first two-way remote controller being provided with a first code learn button and a first calling button; and at least one two-way finder being provided with a third code learning button and a third calling button; the third calling button being able to transmit a unique third calling code when being pushed, and the third code learning button can do code learning when it is pressed, so that the at least one two-way finder and the at least one first two-way remote controller can learn in each other's calling code;

whereby the at least one first two-way remote controller and the at least one two-way finder can remotely call and thereby locate one another bi-directionally; and whereby the two-way remote control unit enables not only one-to-one calling and locating between one first two-way remote controller and one two-way finder, but also multiple remote calling and locating among two or more first two-way remote controllers and two or more two-way finders.

4. The two-way remote control unit as claimed in claim 1 or 2, wherein a distance between the first and the second two-way remote controller can be determined from a signal intensity of the received calling code; and wherein the sound produced by any one of the first and the second two-way remote controller being located becomes louder or quicker when the distance between the first and the second two-way remote controller is decreased; and wherein a signal intensity reference value is preset for the calling code, and a warning sound is produced when a signal intensity of the received calling code is lower than the signal intensity reference value by a predetermined percentage, so as to warn a user of an increased distance between the first and the second two-way remote controller.

5. The two-way remote control unit as claimed in claim 3, wherein one of the first two-way remote controller and the finder that is being called or located can produce a sound, and the sound becomes louder or quicker when a distance between the first two-way remote controller and the finder is decreased; and wherein the distance between the first two-way remote controller and the finder can be determined from a signal intensity of the received calling code; and wherein a signal intensity reference value is preset for the calling code, and a warning sound is produced when a signal intensity of the received calling code is lower than the signal intensity reference value by a predetermined percentage, so as to warn a user of an increased distance between the first two-way remote controller and the finder.

6. The two-way remote control unit as claimed in claim 1 or 2, wherein the at least one first and second two-way remote controllers are wireless remote controllers for general electric appliance.

7. The two-way remote control unit as claimed in claim 3, wherein the at least one first remote controller is a wireless remote controller for general electric appliance.

8. The two-way remote control unit as claimed in claim 1 or 2, wherein the at least one first and second two-way remote controllers are wireless remote controller for automobiles.

9. The two-way remote control unit as claimed in claim 3, wherein the at least one first remote controller is a wireless remote controller for automobile.

10. A two-way remote control unit, comprising at least one two-way remote controller and at least one one-way remote controller; the one-way remote controller being provided with a calling button for transmitting a calling code when being pushed; and the two-way remote controller being provided with a code learning button for learning the calling code transmitted from the one-way remote controller, so that the one-way remote controller is able to remotely call and thereby locate the two-way remote controller.

* * * * *